US008516974B2

(12) United States Patent
Woodard et al.

(10) Patent No.: US 8,516,974 B2
(45) Date of Patent: Aug. 27, 2013

(54) AUTOMATED WET MASKING FOR DIFFUSION COATINGS

(75) Inventors: Nicholas Shawn Woodard, Monroe, OH (US); Albert Dean King, Milan, IN (US)

(73) Assignee: General Electric Company, Schenectady, NY (US)

( * ) Notice: Subject to any disclaimer, the term of this patent is extended or adjusted under 35 U.S.C. 154(b) by 6 days.

(21) Appl. No.: 13/219,841

(22) Filed: Aug. 29, 2011

(65) Prior Publication Data

US 2013/0052344 A1 Feb. 28, 2013

(51) Int. Cl.

| | |
|---|---|
| ***B05B 7/06*** | (2006.01) |
| ***B05B 13/04*** | (2006.01) |
| ***B05C 5/00*** | (2006.01) |
| ***B05C 11/11*** | (2006.01) |
| ***B67D 1/00*** | (2006.01) |
| ***B67D 7/06*** | (2010.01) |
| ***B67D 7/14*** | (2010.01) |
| ***B67D 3/00*** | (2006.01) |
| ***B65D 88/54*** | (2006.01) |

(52) U.S. Cl.
USPC ..... 118/320; 118/313; 118/315; 118/504; 118/642; 222/52; 222/252; 222/546

(58) Field of Classification Search
USPC ..... 118/313, 316, 317, 319, 321
See application file for complete search history.

(56) References Cited

U.S. PATENT DOCUMENTS

| | | | | |
|---|---|---|---|---|
| 3,658,033 | A * | 4/1972 | Fuminier | 118/318 |
| 3,784,169 | A * | 1/1974 | Bockmann et al. | 239/127 |
| 4,041,123 | A * | 8/1977 | Lange et al. | 264/332 |
| 4,921,133 | A * | 5/1990 | Roeser | 222/63 |
| 4,978,558 | A | 12/1990 | Lamm | |
| 5,070,652 | A | 12/1991 | Rhoades et al. | |
| 5,474,799 | A * | 12/1995 | Thigpen et al. | 118/313 |
| 6,224,673 | B1 | 5/2001 | Das et al. | |
| 6,863,927 | B2 * | 3/2005 | Langley et al. | 427/252 |
| 6,884,476 | B2 | 4/2005 | Pfaendtner et al. | |
| 2001/0046181 | A1 | 11/2001 | Paetow, II et al. | |
| 2002/0117559 | A1 * | 8/2002 | Kaligian et al. | 239/413 |
| 2007/0023142 | A1 | 2/2007 | LaGraff et al. | |

OTHER PUBLICATIONS

"Stainless Steel and Galvanized Steel Pressure-Vacuum Tanks", Sealant Equipment & Engineering, Inc., Manufactures of Precision Dispense Systems & Valves, Material Supply Vessels for Delivering Adhesives & Sealants, 2 pages.

"Servo-Flo 105", Sealant Equipment & Engineering, Inc., Manufacturers of Precision Dispense Systems & Valves, Variable Ratio, Positive Rod Displacement Meter System, 2 pages.

* cited by examiner

*Primary Examiner* — Dah-Wei Yuan
*Assistant Examiner* — Binu Thomas
(74) *Attorney, Agent, or Firm* — General Electric Co.; Steven J. Rosen; David J. Clement

(57) ABSTRACT

A wet masking system for applying a maskant to a portion of a workpiece includes one or more pressurized mixing vessels with agitators for continuously blending the ingredients of the maskant, a dispensing system connected to the vessels for supplying metered volumes of maskant to injection valves. An electronic controller operable for controlling the system to coat the portion. A fixture for holding the workpiece with just the portion inside a cavity of the fixture includes one or more inlet ports alignable with injection ports of the injection valves injecting the maskant into the cavity. Heaters are positioned for drying or flash drying the maskant on the portion of the workpiece. Recirculation lines from the injection valves to at least one of the mixing vessels operated by the controller to flow the maskant through the recirculation lines after a period of time when no maskant is flowing through masking system.

20 Claims, 5 Drawing Sheets

AUTOMATED WET MASKING FOR DIFFUSION COATINGS

BACKGROUND OF THE INVENTION

1. Field of the Invention

This application relates generally to methods and apparatus for masking as may be used prior to vapor phase diffusion coating of airfoils of gas turbine engine components such as turbine blades.

2. Description of Related Art

Gas turbine engine components such as blades having airfoils often require coatings such as aluminides for environmental protection or as bond coats. Only a portion of the blade, such as the airfoil, that is exposed to the hot gases of the environment requires such protection. A remainder of the blade, such as the root or dovetail of the blade, may not require such protection. Not only does the remainder of the airfoil not require such protection, coating of that portion of the airfoil may be undesirable.

Turbine blades have an airfoil section which extend outward into the hot gases resulting from the combustion of fuel in the combustor portion of the engine. Because of the high temperatures and corrosive effects of such gases on the airfoil section, the standard practice has been to coat the airfoil portions of the turbine blades airfoils with protective coatings that provide insulation from the extremely high temperatures and environmental protection from the corrosive effects of the hot gases. The root or dovetail of the blade is assembled into dovetail slots on the disk or rotor portion of the engine. The walls of the root or dovetail contact the walls of the dovetail slots of the disk or rotor and are subject to fretting which may be exacerbated by coatings applied to the airfoil portion of the turbine airfoil. Thus, in order to achieve the desired properties in the various portions of the turbine blade to maximize the life of the turbine blade, it has been necessary to devise methods to properly coat the airfoil portion of the turbine airfoil without affecting the dovetail portion of the turbine airfoil.

One of the methods of providing the coating to the desired portion of the turbine blade has been to mask the portion of the turbine blade that does not require coating, that is to say, the dovetail, before inserting the turbine airfoil into a coating apparatus. Masking is generally considered to be useful but it is a time-consuming and labor intensive process. Accordingly, less expensive, less time-consuming and less labor intensive masking methods and apparatus for masking are desired. Less material handling is also desirable for improving quality and mask line repeatability.

SUMMARY OF THE INVENTION

An automated wet masking system for applying a maskant to a portion of a workpiece, the system includes one or more pressurized mixing vessels wherein each of the mixing vessels includes an agitator for continuously blending the ingredients of the maskant and/or maintaining the maskant in the form of a slurry mixture in suspension. A dispensing system hydraulically is connected to and downstream of the one or more pressurized mixing vessels and is operable to supply volumetrically metered amounts of the maskant to one or more injection valves. An electronic controller may be included for controlling the masking system to automatically coat the portion of a workpiece with the maskant.

A fixture may be included for holding the workpiece during the masking process with the portion of the workpiece inside a hollow interior or cavity of the fixture. A top opening in the fixture is operable to place only the portion of the workpiece inside the cavity and one or more inlet ports in one or more sides of the fixture are alignable with one or more injection ports of the one or more injection valves respectively for injecting the maskant into the cavity.

One or more heaters may be operably positioned for drying or flash drying the maskant on the portion of the workpiece.

One or more controllable recirculation lines hydraulically leading from the one or more injection valves to at least one of the mixing vessels and the controller may be included to flow the maskant through the recirculation lines after a period of time when no maskant is flowing through masking system.

The system may further include one or more injection valves may be mounted on one or more powered slides respectively, a rotary table for supporting the workpiece during the masking process at a first angular position of the rotary table, and the one or more heaters operably positioned for drying or flash drying the maskant on the portion of the workpiece at a second angular position of the rotary table. The one or more injection valves may be positioned ninety degrees apart from the one or more heaters respectively.

The system may further include one or more controllable recirculation lines hydraulically leading from the one or more injection valves to at least one of the mixing vessels and the controller operable to flow the maskant through the recirculation lines after a period of time when no maskant is flowing through masking system.

The maskant may include an alcoholic binder material and may further include Aluminum Oxide with trace amounts of Nickel Oxide and Nickel powder.

The system may be used for applying a maskant to a root or dovetail of gas turbine engine blade. The fixture may hold the blade the root or dovetail of gas turbine engine blade inside the hollow interior or cavity of the fixture. The top opening in the fixture is operable for placing only the root or dovetail inside the hollow interior or cavity.

A method for applying a maskant to a portion of a workpiece may use the automated wet masking system and includes loading maskant ingredients into a first one of the one or more pressurized mixing vessels, continuously blending the ingredients of the maskant and/or maintaining the maskant in the form of a slurry mixture in suspension using the agitator in each of the mixing vessels, hydraulically flowing the maskant from the one or more pressurized mixing vessels to the dispensing system, metering the maskant from the dispensing system and hydraulically supplying the maskant from dispensing system to one or more injection valves, and coating the portion of a workpiece with the maskant injected by the one or more injection valves.

BRIEF DESCRIPTION OF THE DRAWINGS

The foregoing aspects and other features of the invention are explained in the following description, taken in connection with the accompanying drawings where.

DETAILED DESCRIPTION OF THE INVENTION

Figure 1:
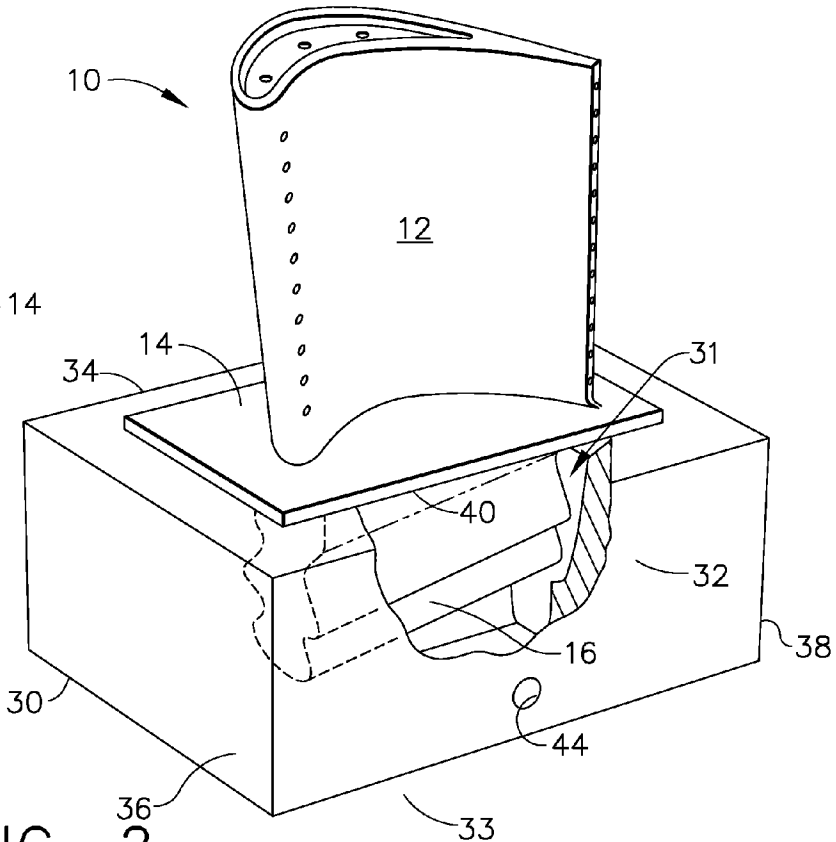
FIG. 1 is a perspective view illustration of a turbine blade.

Illustrated in FIG. 1 is an exemplary turbofan gas turbine engine turbine blade 10 including an airfoil 12 with cooling holes 18 extending radially outwardly from a blade platform 14. A root or dovetail 16 of the blade 10 extends radially inwardly from the blade platform 14. The blade is representative of gas turbine engine components or other workpieces for which the wet masking system and apparatus and method disclosed herein may be used in that a portion of the component requires coating while another portion of the component coating should not be coated and, thus, may be masked prior to the coating process. The airfoil 12 requires coating while the root or dovetail 16 should not be coated.

Figure 2:
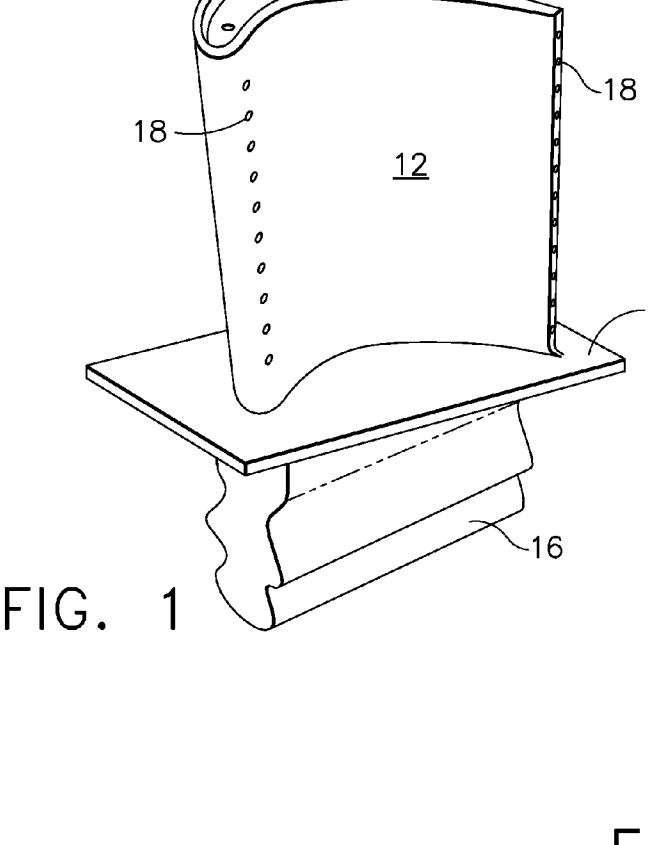
FIG. 2 is a perspective view illustration of the turbine blade illustrated in FIG. 1 mounted in a masking fixture.
Figure 6:
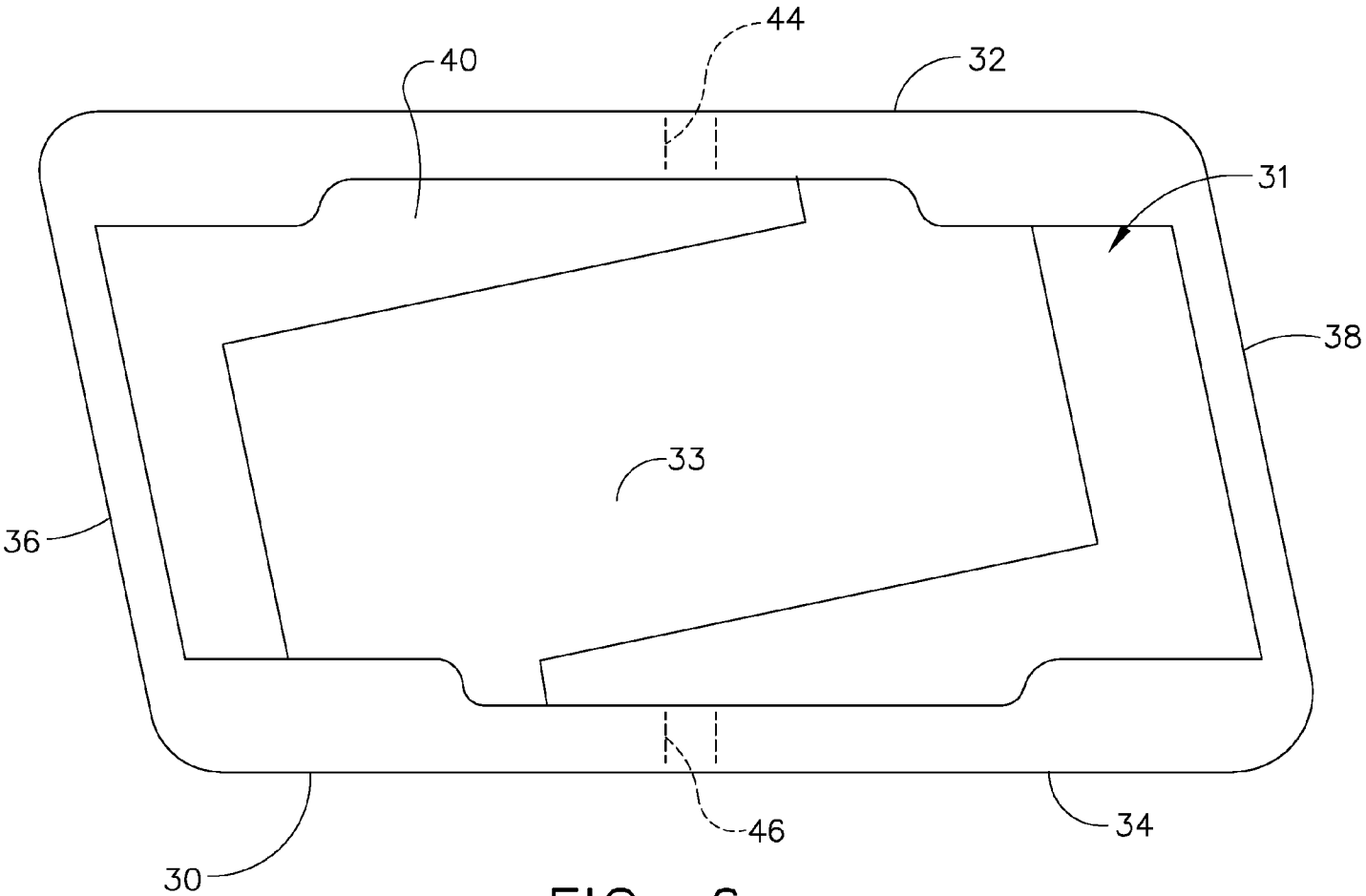
FIG. 6 is a perspective view illustration of the masking fixture illustrated in FIG. 2.

FIG. 2 illustrates a fixture 30 in which the blade 10 is mounted during masking. During the masking, a maskant in the form of a slurry is introduced into a hollow interior or cavity 31 of the box like fixture 30 for coating the dovetail 16 and not the airfoil 12. The fixture 30 includes first and second long sides 32, 34 and first and second short sides 36, 38. A top opening 40 (illustrated in greater detail in FIG. 6) of the fixture 30 is designed to allow only the dovetail 16 of the turbine blade 10 to fit into the cavity 31 of the fixture 30 and the airfoil 12 and the blade platform 14 to remain outside of the fixture 30 and sealed off from the cavity 31. The top opening 40 of the fixture 30 allows access to the cavity 31 for cleaning and fixturing of the blade 10. A bottom wall 33 of the fixture 30 closes off the cavity 31. First and second inlet ports 44, 46 (illustrated in FIG. 6) in the first and second long sides 32, 34 respectively are used to introduce the maskant into the cavity 31 during the masking.

Figure 3:
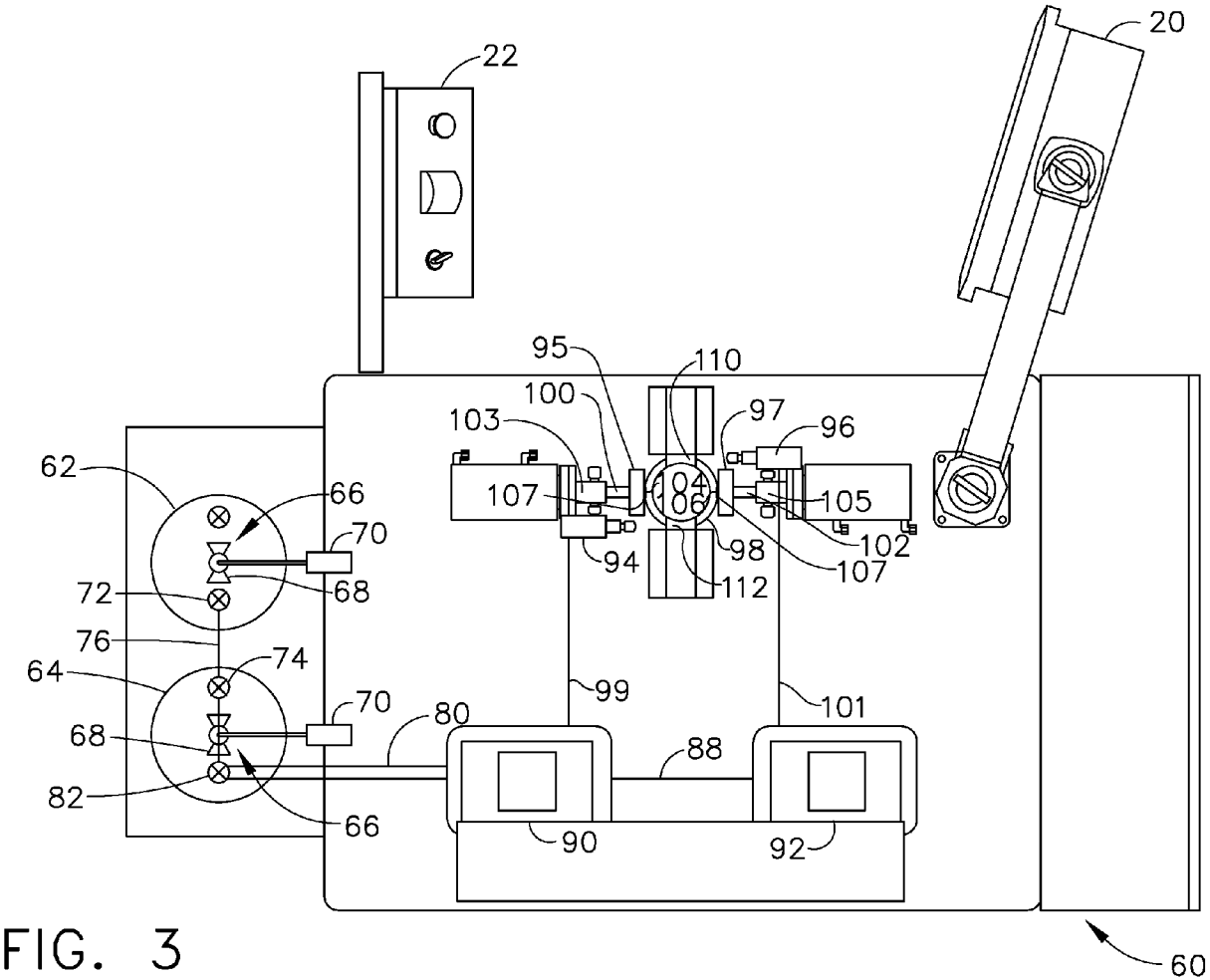
FIG. 3 is a diagrammatical illustration of an automated wet masking system for masking a root of the turbine blade mounted in the masking fixture illustrated in FIG. 2.

An automated wet masking system 60 is illustrated in FIG. 3 for applying the maskant to the dovetail 16 and forming a solid mask on the dovetail. An electronic controller 20 such as one offered by Allen Bradley electronically controls masking system 60 and an operator's station 22 allows an operator to start and shutoff the system. Ingredients used to form the maskant or slurry include metallic and metallic oxide powders along with an alcoholic binder material. An exemplary binder is a blend of Isopropyl, Methyl, and Ethyl alcohols. Exemplary powders include Aluminum Oxide with trace amounts of Nickel Oxide and Nickel powder. The maskant ingredients are manually or otherwise loaded into a pressurized pneumatic-powered first mixing vessel 62 from which a pressurized pneumatic-powered second mixing vessel 64 is filled through first and second shutoff valves 72, 74, respectively and a hydraulic line 76 therebetween. Slurry or maskant lines in the system such as the hydraulic line 76 are typically stainless steel braided rubber hoses.

The mixing vessels include agitators 66 for continuously blending the maskant ingredients together to form and maintain a homogenous mixture of proper or desired viscosity. The wet maskant in the form of a slurry mixture is kept in suspension by the agitators 66 which, as illustrated herein, includes rotating paddles 68 driven by an electric motor 70 and gearbox. The mixing vessels and the rest of the wet masking system 60 is airtight to prevent volatization and evaporation of the binder. Suitable mixing vessels are stainless steel pressure-vacuum tanks available from Sealant Equipment, 45677 Helm Street, P.O. Box 701460, Plymouth, Mich. 48170 USA.

After the first and second mixing vessels 62, 64 are filled, the maskant is flowed through third lines 80, opened and closed by a third shutoff valve 82, to a volumetric metered dispensing system 88. When the maskant is required for application, the air pressurized third lines transport the maskant into the dispensing system 88. The dispensing system 88 disclosed herein includes first and second volumetric metering cells 90, 92 each of which includes a cylindrical cavity with pistons driven by a servo-motor and feed screw. The metering cells are capable of supplying and dispensing accurate volumes of the maskant. The metering cells contain pressure transducers, which verify presence of the maskant before dispensing the maskant.

Figure 4:
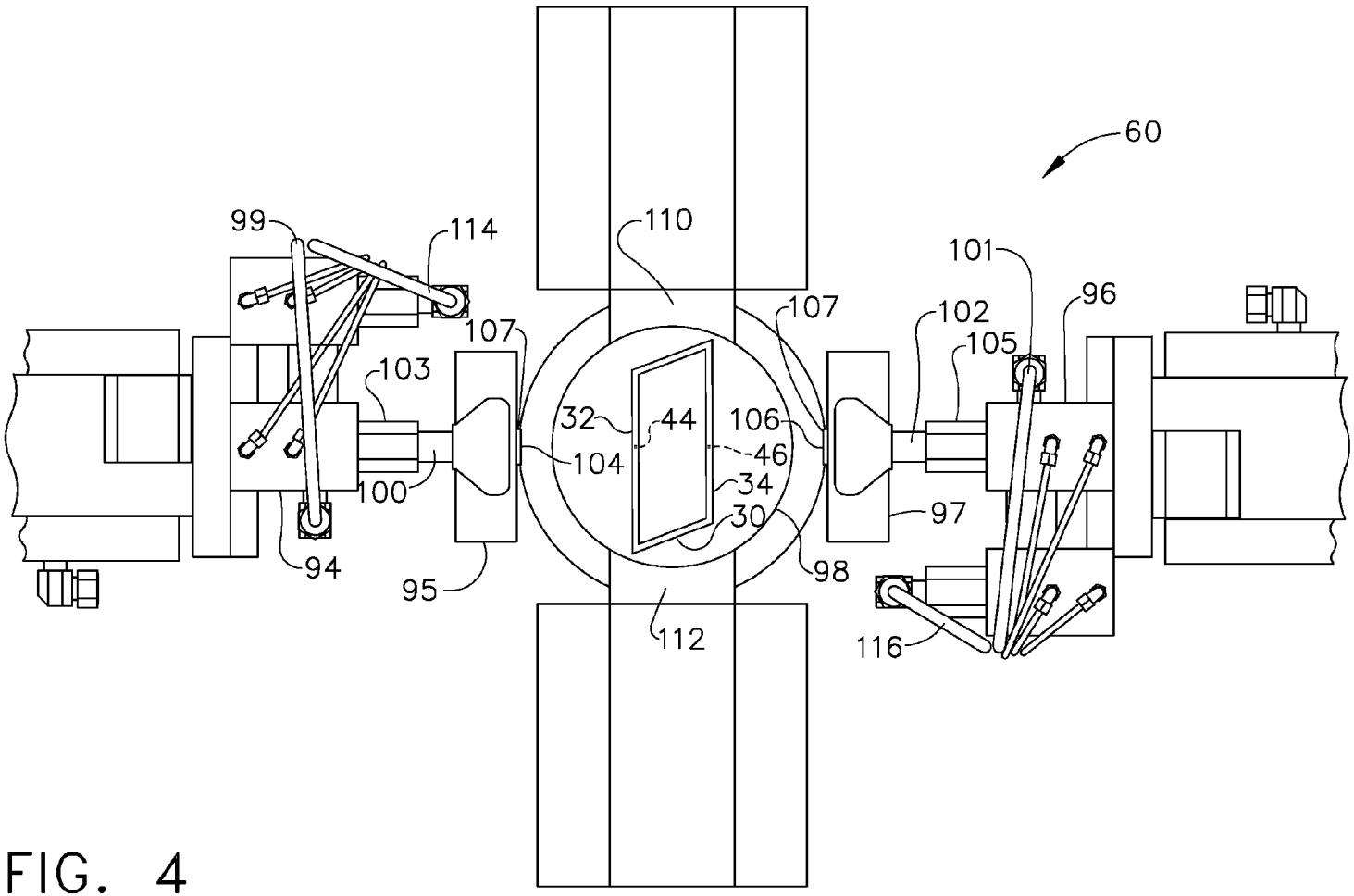
FIG. 4 an enlarged illustration of maskant injection valves and a rotary table for holding the masking fixture in the automated wet masking system illustrated in FIG. 3.
Figure 5:
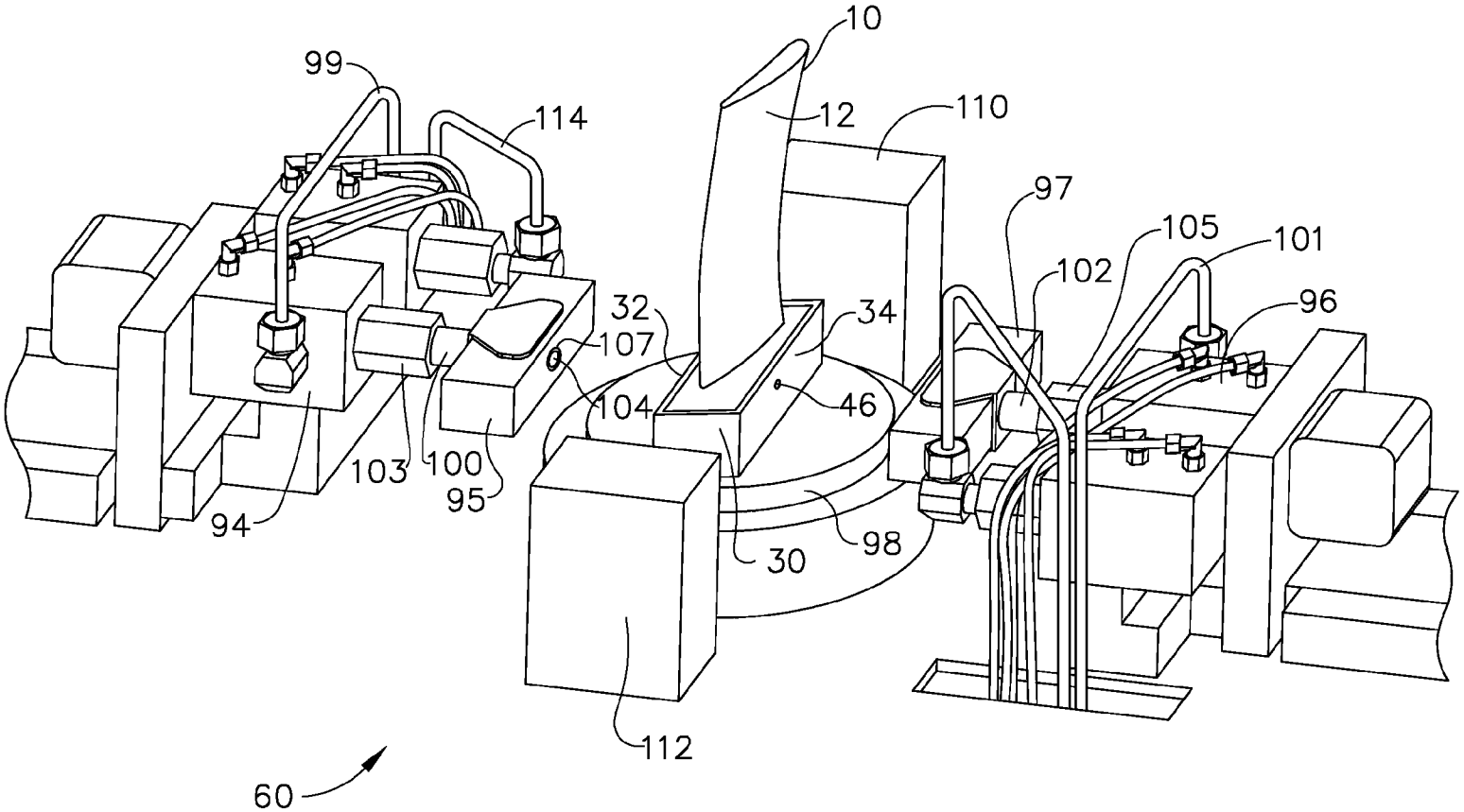
FIG. 5 is a perspective view illustration of the injection valves and the rotary table holding the masking fixture in the automated wet masking system illustrated in FIG. 4.

The maskant is transferred from the first and second volumetric metering cells 90, 92 through high-pressure first and second transfer lines 99, 101 to first and second injection valves 94, 96 illustrated in greater detail in FIGS. 4 and 5. The first and second injection valves 94, 96 are activated when the turbine blade 10 is mounted in the fixture 30 and the fixture 30 is mounted on a rotary table 98 of the masking system 60. The first and second injection valves 94, 96 include first and second maskant plenums 95, 97 mounted on linear first and second slides 100, 102 of pneumatically activated and powered first and second linear actuators 103, 105 respectively. The exemplary automated wet masking system 60 illustrated herein includes the first and second injection valves 94, 96 being located 180 degrees apart on opposite sides of the rotary table 98.

The first and second maskant plenums 95, 97 include first and second injection ports 104, 106. The first and second injection ports 104, 106 are aligned with the first and second inlet ports 44, 46 respectively of the fixture 30 in which the blade 10 is mounted during masking. After the first and second volumetric metering cells 90, 92 are filled with the maskant, the rotary table 98 aligns the first and second injection ports 104, 106 with the first and second inlet ports 44, 46. Then, the linear first and second slides 100, 102 clamp the first and second maskant plenums 95, 97 against the first and second long sides 32, 34 respectively of the fixture 30. This seals the first and second injection ports 104, 106 of the first and second injection valves 94, 96 against the first and second inlet ports 44, 46 respectively. The first and second injection ports 104, 106 include seals 107 made of rubber or some other elastomeric material to help seal the first and second injection ports 104, 106 against the first and second inlet ports 44, 46 respectively.

After the fixture 30 with the blade 10 is mounted and secured on the rotary table 98, the wet masking system 60 uses proximity sensors (not illustrated herein) to detect the blade 10 and begin coating the root or dovetail of the blade with the maskant. The first and second injection valves 94, 96 are moved linearly towards and clamped against the first and second long sides 32, 34 of the fixture 30 by the linear first and second slides 100, 102 respectively. The first and second injection ports 104, 106 are aligned and in fluid communication with the first and second inlet ports 44, 46 at this point in the process.

The electronic controller 20 instructs the dispensing system 88 to pump a metered amount of the maskant at a predetermined or controlled rate from the first and second volumetric metering cells 90, 92 into the first and second valves 94, 96 respectively. The predetermined rate is controllable by the controller 20. The electronic controller 20 then opens the first and second valves 94, 96 and the maskant is then injected by the first and second valves 94, 96 through the first and second inlet ports 44, 46 in the first and second long sides 32, 34 respectively and into the cavity 31.

After a predetermined metered amount of maskant from the first and second volumetric metering cells 90, 92 has been injected into the cavity, the dovetail 16 is coated with the wet maskant. Next, the controller 20 closes the first and second valves 94, 96 and linearly retracts the first and second injection valves 94, 96 away from the first and second long sides 32, 34 of the fixture 30 using the linear first and second slides 100, 102 respectively. After the first and second injection valves 94, 96 have been unclamped and retracted far enough away from the first and second long sides 32, 34 the controller 20 rotates the rotary table 98 from a first angular position ninety degrees to a second angular position to present the first and second long sides 32, 34 to first and second heaters 110, 112. The maskant is flash dried on the dovetail 16 by the heaters and then the operator removes the fixture 30 from the rotary table 98. Thus, completing the automated masking of the dovetail.

When the maskant is not being applied, such as between blades, the maskant is recirculated by the masking system 60 to prevent the maskant from drying up in and clogging the system. First and second recirculation lines 114, 116 lead from the first and second valves 94, 96 respectively to the first mixing vessel 62. The controller 20 controls how long the maskant isn't flowing through the system and determines when to open the first and second recirculation lines 114, 116 and flow the maskant therethrough, typically when no blade is mounted in the system. A predetermined amount of time with no maskant flowing through the system may be used to open the first and second recirculation lines 114, 116 and start flowing the maskant therethrough. An exemplary predetermined amount of time with no flow in the system is about 5 minutes.

The present invention has been described in an illustrative manner. It is to be understood that the terminology which has been used is intended to be in the nature of words of description rather than of limitation. While there have been described herein, what are considered to be preferred and exemplary embodiments of the present invention, other modifications of the invention shall be apparent to those skilled in the art from the teachings herein and, it is, therefore, desired to be secured in the appended claims all such modifications as fall within the true spirit and scope of the invention.

Accordingly, what is desired to be secured by Letters Patent of the United States is the invention as defined and differentiated in the following claims.

What is claimed is:

1. An automated wet masking system for applying a wet maskant to a portion of a workpiece, the system comprising:

one or more pressurized mixing vessels, the one or more pressurized mixing vessels containing ingredients of wet maskant and/or the maskant in a slurry mixture in suspension, each of the one or more mixing vessels including an agitator for continuously blending the ingredients of the wet maskant and/or maintaining the wet maskant in the slurry mixture in suspension, a dispensing system hydraulically connected to and downstream of the one or more pressurized mixing vessels, the dispensing system hydraulically connected to one or more injection valves and operable for supplying and dispensing metered volumes of the wet maskant to the injection valves, the one or more injection valves mounted on one or more powered slides operable to linearly move the one or more injection valves respectively, a rotary table for supporting the workpiece at a first angular position of the rotary table, and one or more heaters operably positioned for drying or flash drying the wet maskant on the portion of the workpiece at a second angular position of the rotary table.

2. The automated wet masking system of claim 1, further comprising an electronic controller for controlling the automated wet masking system to automatically coat the portion of a workpiece with the wet maskant.

3. The automated wet masking system of claim 2, further comprising:

a fixture for holding the workpiece during a masking process to automatically coat the portion of a workpiece with the wet maskant with the portion of the workpiece inside a hollow interior or cavity of the fixture, a top opening in the fixture operable to place only the portion of the workpiece inside the cavity, and one or more inlet ports in one or more sides of the fixture are alignable with one or more injection ports of the one or more injection valves respectively for injecting the wet maskant into the cavity for coating the portion of the workpiece.

4. The automated wet masking system of claim 3, further comprising one or more heaters operably positioned for drying or flash drying the wet maskant on the portion of the workpiece.

5. The automated wet masking system of claim 3, further comprising one or more controllable recirculation lines hydraulically leading from the one or more injection valves to at least one of the mixing vessels and the electronic controller operable to flow the wet maskant through the recirculation lines after a period of time when no maskant is flowing through the automated wet masking system.

6. An automated wet masking system for applying a maskant to a portion of a workpiece, the system comprising:

one or more pressurized mixing vessels, each of the mixing vessels including an agitator for continuously blending ingredients of the maskant and/or maintaining the maskant in the form of a slurry mixture in suspension, a dispensing system hydraulically connected to and downstream of the one or more pressurized mixing vessels, the dispensing system hydraulically connected to one or more injection valves and operable for supplying and dispensing metered volumes of the maskant to the injection valves, an electronic controller for controlling the automated wet masking system for automatically coating the portion of a workpiece with the maskant, a fixture for holding the workpiece during the coating with the portion of the workpiece inside a hollow interior or cavity of the fixture, a top opening in the fixture operable to place only the portion of the workpiece inside the cavity, one or more inlet ports in one or more sides of the fixture are alignable with one or more injection ports of the one or more injection valves respectively for injecting the maskant into the cavity for the coating of the portion of the workpiece, the one or more injection valves mounted on one or more powered slides operable to linearly move the one or more injection valves respectively, a rotary table for supporting the workpiece during the coating of the portion of the workpiece at a first angular position of the rotary table, and the one or more heaters operably positioned for drying or flash drying the maskant on the portion of the workpiece at a second angular position of the rotary table.

7. The automated wet masking system of claim 6, further comprising the one or more injection valves positioned ninety degrees apart from the one or more heaters respectively.

8. The automated wet masking system of claim 7, further comprising one or more controllable recirculation lines hydraulically leading from the one or more injection valves to at least one of the mixing vessels and the controller operable to flow the maskant through the recirculation lines after a period of time when no maskant is flowing through the automated wet masking system.

9. The automated wet masking system of claim 8, further comprising the maskant including an alcoholic binder material.

10. The automated wet masking system of claim 9, further comprising the maskant further including metallic and metallic oxide powders.

11. An automated wet masking system for applying a wet maskant to a root or dovetail of a gas turbine engine blade, the system comprising:

at least hydraulically connected serially inline first and second pressurized mixing vessels, the one or more pressurized mixing vessels containing ingredients of the wet maskant and/or the wet maskant in a slurry mixture in suspension, each of the pressurized mixing vessels including an agitator for continuously blending ingredients of the wet maskant and/or maintaining the wet maskant in the form of a slurry mixture in suspension, a dispensing system hydraulically connected to and downstream of the second pressurized mixing vessel, the dispensing system hydraulically connected to first and second injection valves and hydraulically connected and operable for supplying and dispensing metered volumes of the wet maskant to the first and second injection valves, the first and second injection valves mounted on first and second powered slides operable to linearly move the one or more injection valves respectively, the dispensing system and the first and second injection valves operable for applying the wet maskant to the root or dovetail of the gas turbine engine blade, a rotary table for supporting the gas turbine engine blade at a first angular position of the rotary table, one or more heaters operably positioned for drying or flash drying the wet maskant on the root or dovetail of the gas turbine engine blade at a second angular position of the rotary table, and an electronic controller for controlling the automated wet masking system to automatically coat the root or dovetail with the wet maskant.

12. The automated wet masking system of claim 11, further comprising:

a fixture for holding the gas turbine engine blade during coating of the root or dovetail with the wet maskant with the root or dovetail of the gas turbine engine blade inside a hollow interior or cavity of the fixture, a top opening in the fixture operable to place only the root or dovetail of the blade inside the hollow interior or cavity, and first and second inlet ports in first and second sides of the fixture are alignable with first and second injection ports of the first and second injection valves respectively for injecting the wet maskant into the hollow interior or cavity for coating the root or dovetail of the gas turbine engine blade.

13. The automated wet masking system of claim 12, further comprising first and second heaters operably positioned for drying or flash drying the wet maskant on the root or dovetail of the gas turbine engine blade.

14. The automated wet masking system of claim 13, further comprising:

first and second more controllable recirculation lines hydraulically leading from the first and second injection valves to at least one of the first and second pressurized mixing vessels, and the controller operable to flow the wet maskant through the recirculation lines after a period of time when no maskant is flowing through masking system.

15. The automated wet masking system of claim 14, further comprising the wet maskant including an alcoholic binder material.

16. The automated wet masking system of claim 15, further comprising the wet maskant further including metallic and metallic oxide powders.

17. An automated wet masking system for applying a maskant to a root or dovetail of gas turbine engine blade, the system comprising:

at least hydraulically connected serially inline first and second pressurized mixing vessels, each of the mixing vessels including an agitator for continuously blending the ingredients of the maskant and/or maintaining the maskant in the form of a slurry mixture in suspension, a dispensing system hydraulically connected to and downstream of the second pressurized mixing vessel, the dispensing system hydraulically connected to first and second injection valves and hydraulically connected and operable for supplying and dispensing metered volumes of the maskant to the first and second injection valves, and an electronic controller for controlling the masking system to automatically coat the root or dovetail with the maskant, a fixture for holding the gas turbine engine blade during the masking process with the root or dovetail of gas turbine engine blade inside a hollow interior or cavity of the fixture, a top opening in the fixture operable to place only the root or dovetail of the blade inside the hollow interior or cavity, and first and second inlet ports in first and second sides of the fixture are alignable with first and second injection ports of the first and second injection valves respectively for injecting the maskant into the hollow interior or cavity for coating the root or dovetail of the blade, first and second heaters operably positioned for drying or flash drying the maskant on the root or dovetail of the blade, the first and second injection valves mounted on first and second powered slides operable to linearly move the first and second injection valves respectively, a rotary table for supporting the gas turbine engine blade during the masking process at a first angular position of the rotary table, and the first and second heaters operably positioned for drying or flash drying the maskant on the root or dovetail of the gas turbine engine blade at a second angular position of the rotary table.

18. The automated wet masking system of claim 17, further comprising:

the first and second injection valves positioned 180 degrees apart from each other and 90 degrees apart from the first and second heaters respectively, and first and second controllable recirculation lines hydraulically leading from the first and second injection valves to at least one of the first and second mixing vessels and the electronic controller operable to flow the maskant through the recirculation lines after a period of time when no maskant is flowing through the automated masking system.

19. The automated wet masking system of claim 18, further comprising the maskant including an alcoholic binder material.

20. The automated wet masking system of claim 19, further comprising the maskant further including metallic and metallic oxide powders.

* * * * *